US005418987A

United States Patent [19]

Yoshino

[11] Patent Number: 5,418,987

[45] Date of Patent: May 30, 1995

[54] BED APPARATUS

[75] Inventor: Isamu Yoshino, Kamifukuoka, Japan

[73] Assignee: France Bed Co., Ltd., Tokyo, Japan

[21] Appl. No.: 244,958

[22] PCT Filed: Mar. 4, 1993

[86] PCT No.: PCT/JP93/00276

§ 371 Date: Jun. 15, 1994

§ 102(e) Date: Jun. 15, 1994

[87] PCT Pub. No.: WO94/09685

PCT Pub. Date: May 11, 1994

[30] Foreign Application Priority Data

Oct. 30, 1992 [JP] Japan ..... 4-81320 U
Nov. 20, 1992 [JP] Japan ..... 4-86189 U

[51] Int. Cl.[6] ..... A47C 19/02

[52] U.S. Cl. ..... 5/11; 5/611; 5/215.1; 5/312

[58] Field of Search ..... 5/11, 610, 611, 312, 5/314.1, 315.1, 315.2, 316

[56] References Cited

U.S. PATENT DOCUMENTS 1,875,435 9/1932 Franzen ..... 5/11 X
1,918,003 7/1933 Taylor et al. ..... 5/315.1 X
2,675,285 4/1954 Terry et al. ..... 5/611 X
2,725,579 12/1955 Derby ..... 5/11 X
2,889,561 6/1959 Martin ..... 5/611 X
3,003,159 10/1961 Hebert et al. ..... 5/611
4,087,872 5/1978 Smirle ..... 5/611
4,224,704 9/1980 Nowell .
4,942,633 7/1990 Thomas et al. ..... 5/11 X

FOREIGN PATENT DOCUMENTS 2644064 4/1978 Germany .
47-32088 9/1972 Japan .
57-829 1/1982 Japan .

*Primary Examiner*—Michael F. Trettel
*Attorney, Agent, or Firm*—Frishauf, Holtz, Goodman & Woodward

[57] ABSTRACT

This invention is to provide capable of easily and properly changing a height in several steps with a simple structure, includes a support link 20 and a reception link 28 in which a slider 43 is slidably housed. The support link 20 and reception link 28 are pivotally disposed in a base 1. An engaging pin 22 is formed on the support link 20. A guide portion 39 having a plurality of engaging portions 40 formed at predetermined intervals along the longitudinal direction is formed in the reception link 28. The engaging pin 22 is slidably inserted into the guide portion 39. when the reception link 28 is pivoted, the slider 43 inhibits or allows the engaging pin 22 to engage with the engaging portion 40 in accordance with the pivot direction of the reception link 28.

7 Claims, 6 Drawing Sheets

BED APPARATUS

TECHNICAL FIELD

The present invention relates to a bed apparatus capable of changing its height.

BACKGROUND ART

The height of a bed apparatus is normally predetermined. That is, the height of the bed apparatus is set to a predetermined height which allows convenient use for a user having an average physical construction.

For example, a user lies or sits on such a bed apparatus every day. The user repeatedly gets on/off the bed apparatus every time he lies or sits on the bed apparatus.

Various users such as tall, short, young, old, and healthy persons and a patient use such bed apparatuses.

Of these users, for example, a short person who tries to sit on a bed apparatus whose mattress surface is set high, finds it difficult to do so.

It is, similarly, too difficult for an old person or patient to get on/off a bed apparatus whose mattress surface is set high. The optimal height of a bed apparatus varies depending on users. Strong demand has arisen for developing a bed apparatus capable of changing the height depending on the need of a user.

To solve this problem, a hospital bed apparatus used in a hospital is available. In a height-adjustable hospital bed apparatus, a complicated link mechanism mounted on the lower surface of a base is actuated by a power source to vertically move the base.

A conventional bed apparatus capable of changing its height by means of a power source has a very complicated structure. For this reason, this bed apparatus is too expensive.

SUMMARY OF THE INVENTION

It is an object of the present invention to provide a simple, inexpensive bed apparatus capable of facilitating height adjustment.

According to an aspect of the present invention, there is provided a bed apparatus capable of changing the support height of a base having an upper surface on which a mattress is placed, comprising a support link having two end portions, one end portion being pivotally coupled to the base, a reception link having a storage portion surrounded by side walls along a longitudinal direction, the storage portion pivotally receiving the other end portion of the support link, and the reception link having two end portions, one end portion of said reception link being pivotally coupled to the base at a position spaced apart from the one end portion of the support link by a predetermined distance, a guide portion having a plurality of engaging portions on at least one side wall of the reception link from one longitudinal end to the other longitudinal end, an engaging pin at the other end portion of the support link and slidably inserted in the guide portion, and a slider which is slidable relative to the reception link when a larger force than a weight of the slider acts on the storage portion of the reception link, the slider being slid upon engagement with the engaging pin, the slider inhibiting engagement of the engaging pin with the engaging portions when the engaging pin is slid from one end to the other end of the guide portion, and the slider allowing engagement of the engaging pin with an engaging portion when the engaging pin is slid from the other end to the one end of the guide portion.

With the above structure, when the engaging pin supports the base in a state wherein the engaging pin is located at the other end, i.e., the lower end portion of the guide portion, and the reception link is pivoted to stand up by its own weight, the engaging pin tends to slide from the other end to one end of the guide portion together with the slider. The base is moved downward at an appropriate slide position to bring the reception link into contact with the ground. The reception link is then pivoted in a direction opposite to the pivot direction of its own weight. The engaging pin engages with one of the engaging portions of the guide portion at an appropriate position, thereby preventing pivotal movement of the reception link. Therefore, the base is supported at the current pivot angle of the reception link.

When the base is kept lifted and the base is moved downward to bring the reception link into contact with the ground upon sliding the engaging pin to the upper end portion of the guide portion, the engaging pin is prevented by the slider from being engaged with the engaging portion. The engaging pin is slid to the other end portion of the guide portion. Therefore, the reception link is pivoted in a direction to lie until the engaging pin reaches the distal end of the guide portion at the other end, thereby supporting the base at a height corresponding to the current pivot angle.

To change the support height of the base, the pair of reception links disposed in correspondence with the widthwise direction of the base are coupled by a coupling member. The pair of reception links are interlockingly pivoted.

DETAILED DESCRIPTION

The embodiments of the present invention will be described with reference to the accompanying drawings.

Figure 1:
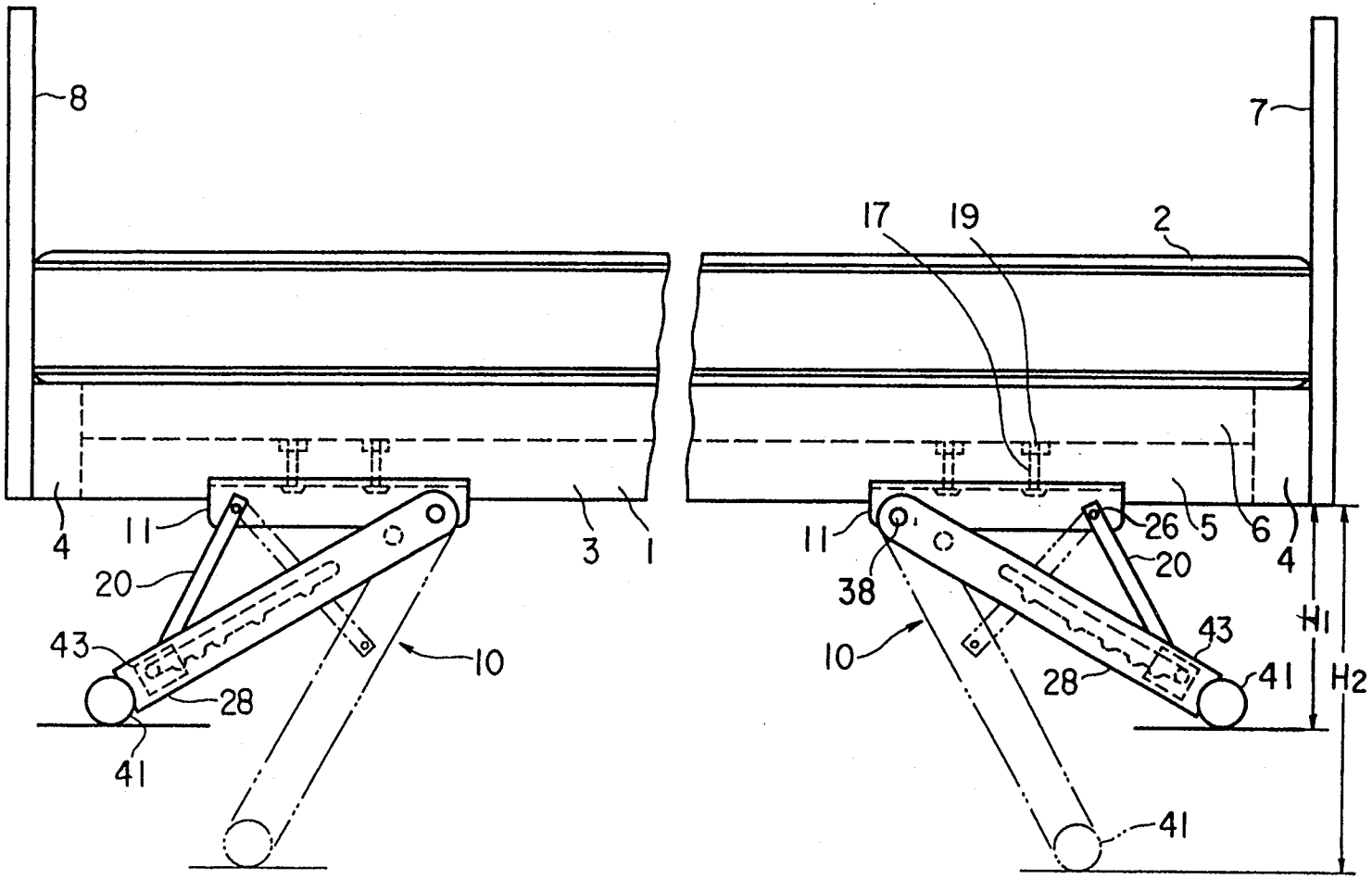
FIG. 1 is a front view of a bed apparatus according to the first embodiment of the present invention.
Figure 4:
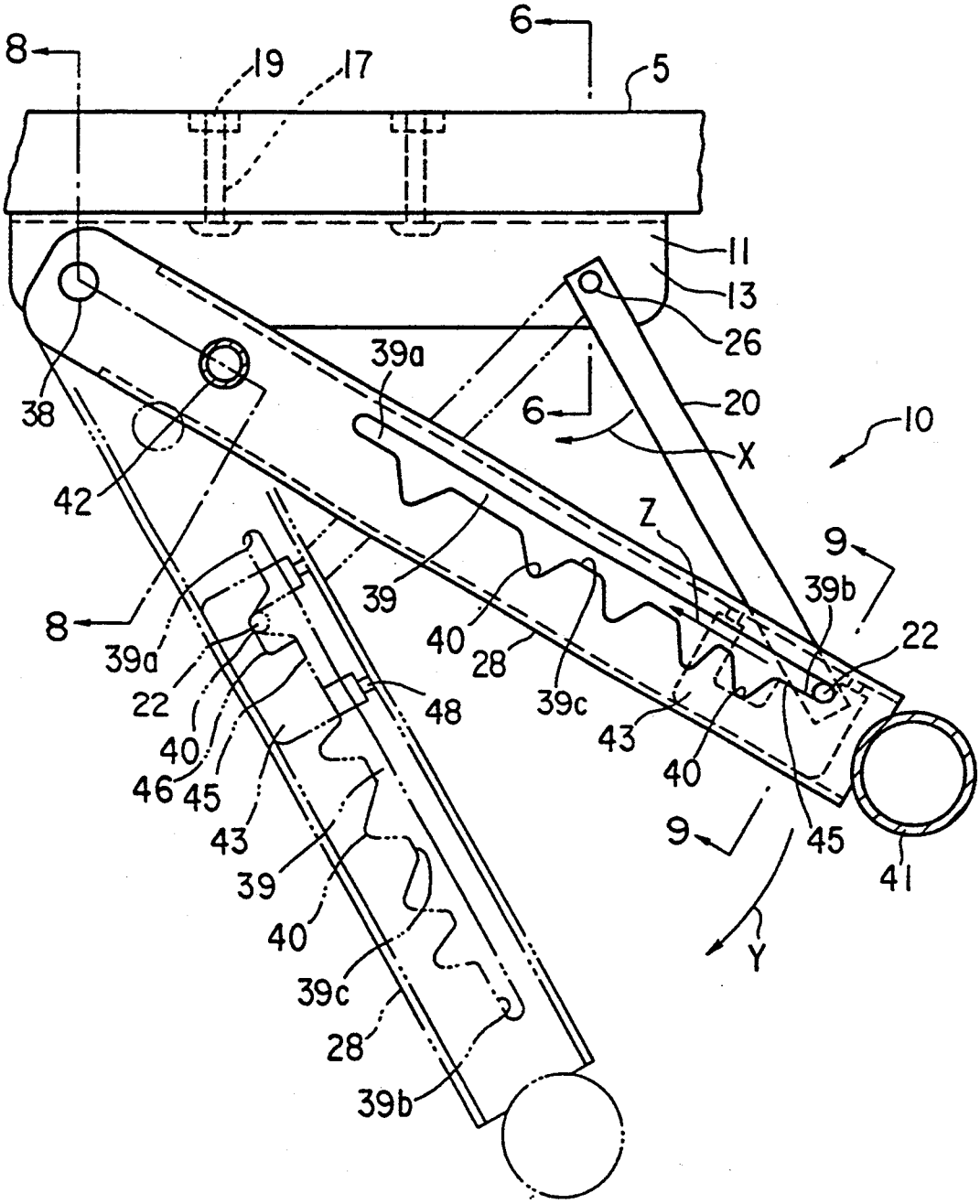
FIG. 4 is a side view showing a link mechanism along the line 4—4 in FIG. 2.
Figure 5:
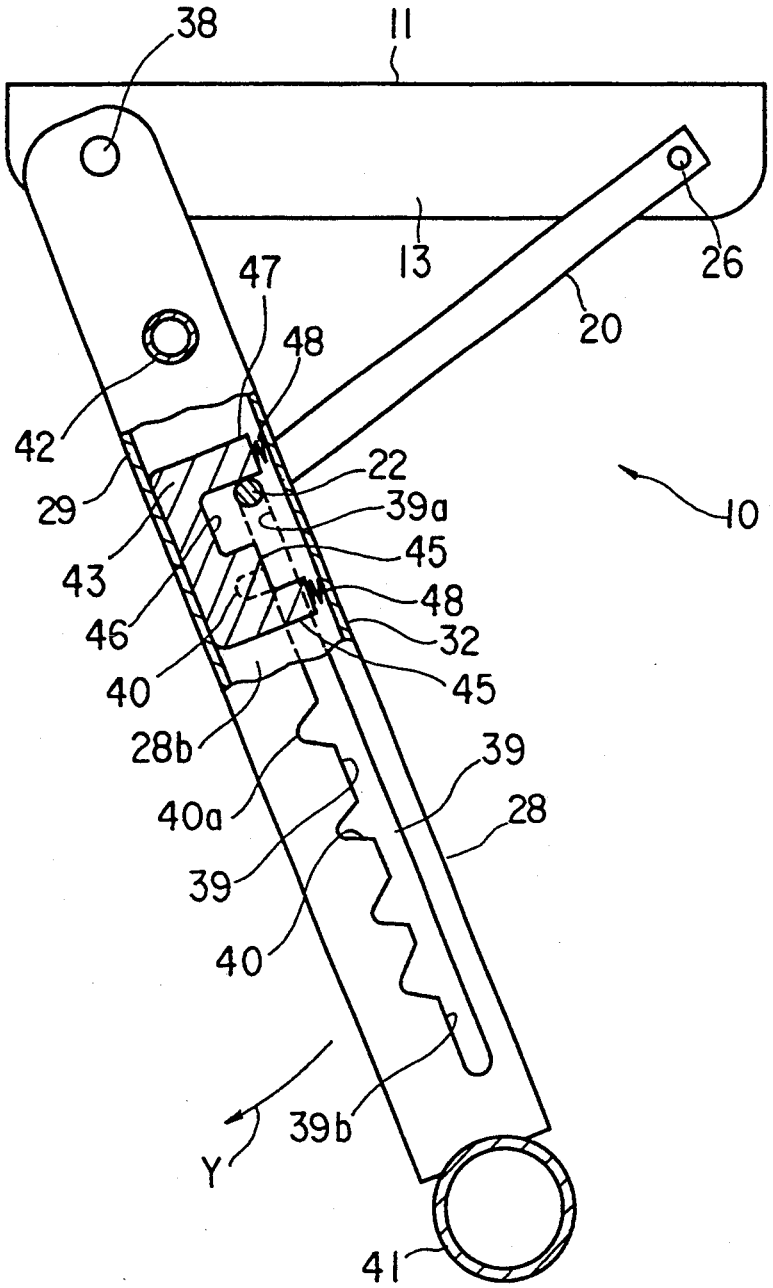
FIG. 5 is a partially cutaway sectional side view of the link mechanism in which an engaging pin is engaged with the uppermost end portion of an elongated groove in a reception link.
Figure 6:
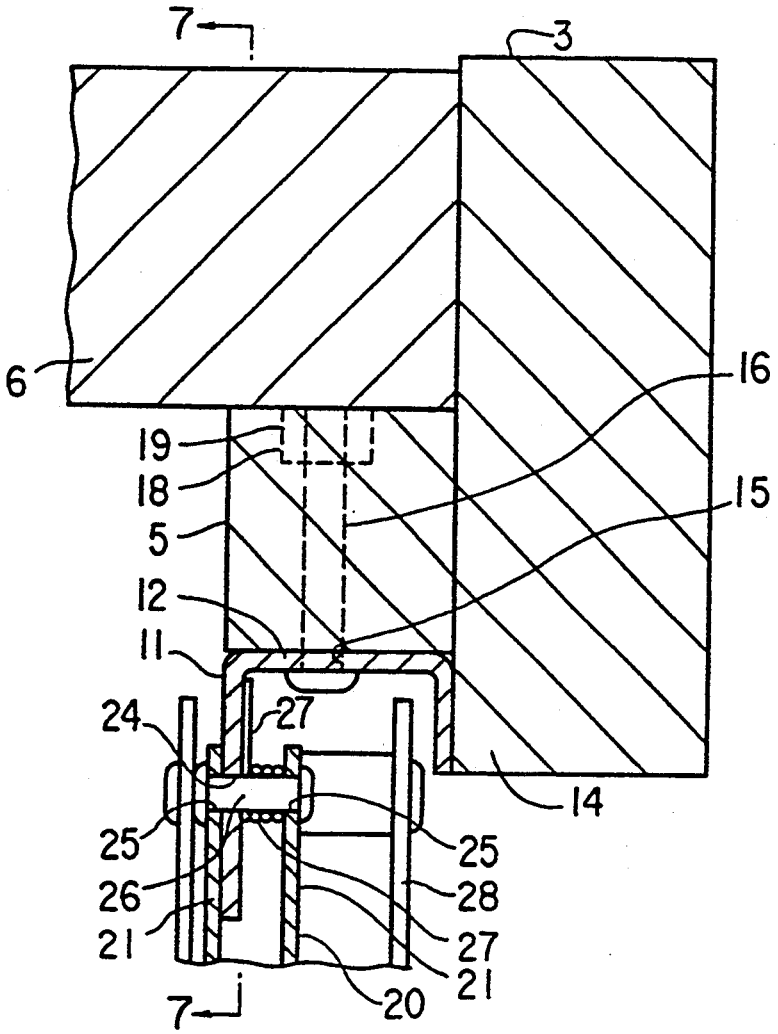
FIG. 6 is a sectional view showing one end portion of a support link along the line 6—6 in FIG. 4.

FIGS. 1 to 9 show the first embodiment of the present invention. A bed apparatus shown in FIG. 1 comprises a base 1 on which a mattress 2 is placed. This base 1 is made of a pair of elongated longitudinal rails 3 and a pair of lateral rails 4 disposed at both the longitudinal end portions of the longitudinal rails 3 to constitute a bed frame. Reception rails 5 are respectively formed at vertically intermediate portions on the opposing inner surfaces of the pair of longitudinal rails 3 along the longitudinal direction of the longitudinal rails 3, as shown in FIGS. 1 and 6.

A floor board 6 is placed in a portion surrounded by the pair of longitudinal rails 3 and the pair of lateral rails 4 such that both widthwise end portions of the floor board 6 are engaged with the reception rails 5. A headboard 7 and a footboard 8 detachably extend at one longitudinal end portion and the other longitudinal end portion of the base 1, respectively.

Link mechanisms 10 are mounted on the lower surface of the base 1 at positions of both the widthwise end portions. Each link mechanism 10 is constructed such that the support height of the base 1 can be changed in several steps (to be described later). Note that the link mechanisms 10 mounted at both end portions of the base 1 are identical to each other although they are mounted so as to be included in opposite directions. Only one link mechanism 10 will be described below.

Figure 8:
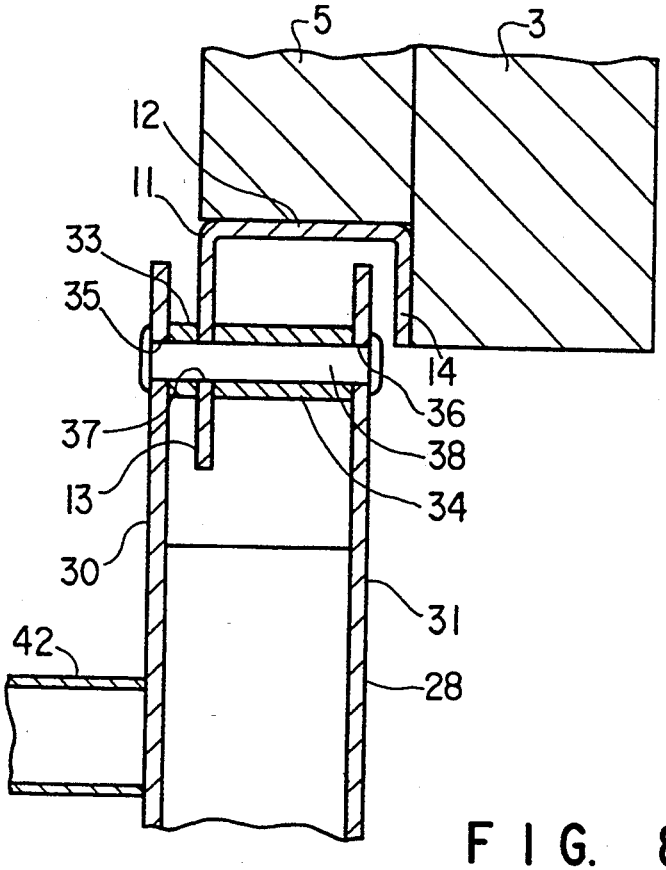
FIG. 8 is a sectional view of one end portion of the reception link along the line 8—8 in FIG. 4.

Fixing members 11 each having a predetermined length are mounted on the lower surface of the pair of reception rails 5 at longitudinal end portions of the pair of reception rails 5. As shown in FIGS. 6 and 8, each fixing member 11 comprises a rectangular upper surface portion 12 and first and second suspending pieces 13 and 14 extending downward from both of the widthwise end portions of the upper surface portion 12. A bolt 17 is vertically inserted through a hole 15 formed in the upper surface portion 12 of each fixing member 11 and a hole 16 formed in the corresponding reception rail 5. The bolt 17 is threadably engaged with a nut body 19 formed in a recess 18 formed in the upper end of the corresponding reception rail 5, thereby fixing each fixing member 11 to the corresponding reception rail 5.

Figure 9:
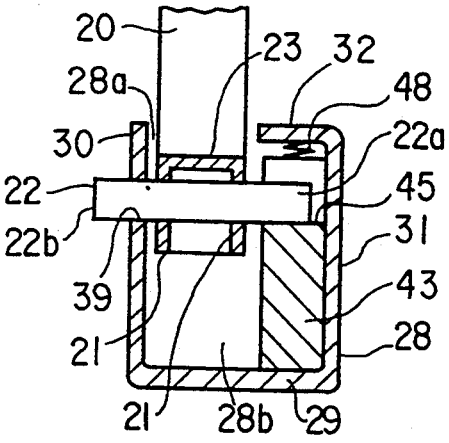
FIG. 9 is a sectional view of the other end portion of the reception link along the line 9—9 in FIG. 4.

One end portion (upper end portion) of a support link 20 having a U-shaped cross-section is pivotally supported at one end of the first suspending piece 13 of the corresponding fixing member 11. As shown in FIG. 9, an engaging pin 22, both end portions of which extend through side surface portions 21, is fixed on the other end portion of this support link 20.

Figure 7:
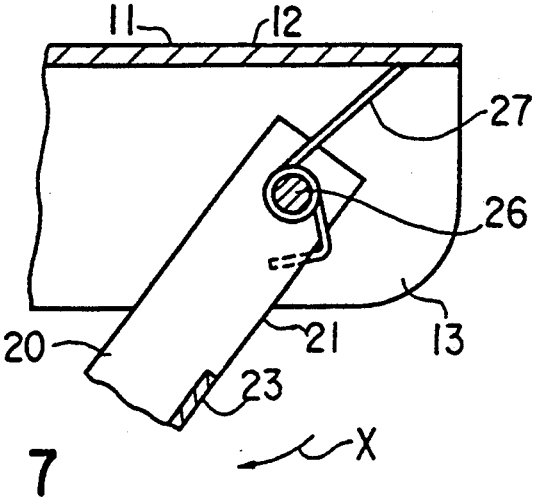
FIG. 7 is a sectional view along the line 7—7 in FIG. 6.

An upper surface portion of the support link 20 at one longitudinal end portion is cut, as shown in FIG. 7. One longitudinal end portion of this support link 20 is pivotally supported by a pin 26 inserted into a hole 24 and holes 25 through the first suspending piece 13 of each fixing member 11 between both of the side surface portions 21. The hole 24 is formed in the first suspending piece 13, and the holes 25 are formed in both of the side surface portions 21 at one longitudinal end portion of the support link 20.

A spring body 27 is mounted on the pin 26, as shown in FIG. 7. One end of this spring body 27 is engaged with the inner surface of the upper surface portion 12 of the corresponding fixing member 11, and the other end of the spring body 27 is bent to constitute an L-shaped portion which is then locked at the upper end edge of one side surface portion 21 of the corresponding support link 20. This spring body 27 biases the corresponding support link 20 in a direction indicated by an arrow x in FIGS. 7 and 4, i.e., in a clockwise direction to pivot the support link 20 about the longitudinally central portion of the base 1, as indicated by a chain double-dashed line in FIG. 4.

One end portion of a reception link 28 is pivotally supported at the other end of each fixing member 11, as shown in FIGS. 4 and 8. As shown in FIG. 9, this reception link 28 has an almost U-shaped structure constituted by a bottom surface portion 29 and side surface portions 30 and 31. The upper end portion of the side surface portion serving as a widthwise outer portion of the base 1 is bent inward to form a reception portion 32. An opening **28*a* extending almost the entire length of the reception link 28 in the longitudinal direction is formed between the distal end of this reception portion 32 and the upper end of one side surface portion 30 and 31**.

The bottom surface portion 29 is cut at one longitudinal end portion (upper end portion) of the reception link 28, as shown in FIG. 8. The first suspending piece 13 of each fixing member 11 is located between both of the side surface portions 30 and 31 at one end portion of the corresponding reception link 28. A first cylindrical spacer 33 is disposed between one side surface portion 30 of the reception link 28 and the corresponding first suspending piece 13. A second cylindrical spacer 34 is disposed between the other side surface portion 31 and this first suspending piece 13.

Holes 35 and 36 are formed in the pair of side surface portions 30 and 31 of the reception link 28, respectively. A pin 38 extends through the holes 35 and 36, a hole 37 formed in the first suspending piece 13, and the first and second spacers 33 and 34, so that one end portion of each reception link 28 is pivotally supported to the corresponding fixing member 11. Note that the end portions of the pin 38 are caulked to prevent removal upon insertion.

An elongated groove 39 serving as a guide portion is formed in a vertically intermediate portion of the inner side surface portion 30 of the reception link 28 along the longitudinal direction of the reception link 28, as shown in FIGS. 4 and 5. A plurality of engaging portions 40 constituted by almost semicircular recesses which communicate with this elongated groove 39 are formed at the lower end portion of the elongated groove 39 at appropriate intervals along the longitudinal direction of the elongated groove 39. An upper linear portion **39*a* extending upward from the uppermost engaging portion 40 is formed at one end portion of the elongated groove 39 which serves as the upper end portion of the reception link 28. A lower linear portion 39*b* extending downward from the lower most engaging portion 40 is formed at the other end portion of the elongated groove 39**.

Figure 2:
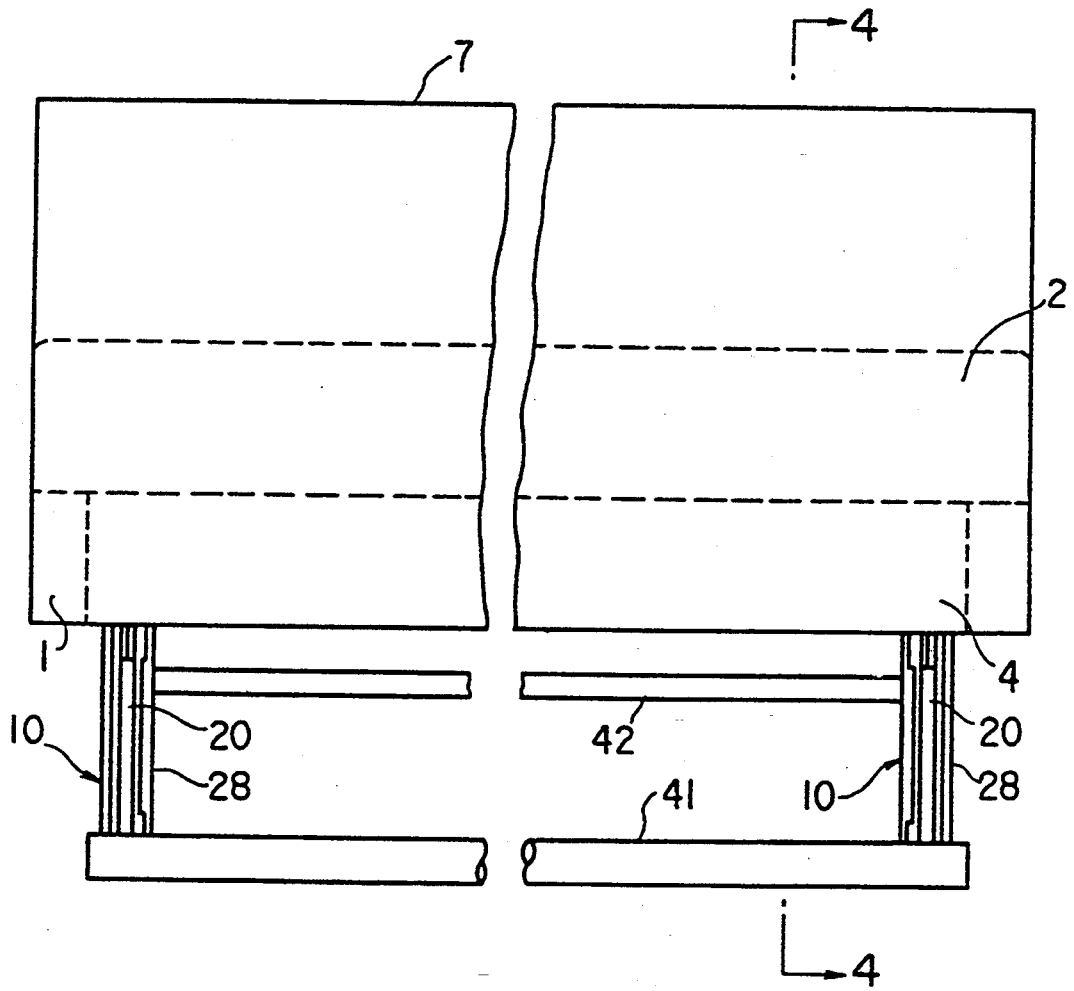
FIG. 2 is a side view of the bed apparatus of the first embodiment.

Each of the two end portions of a lower coupling member 41 is coupled to the other longitudinal end of a corresponding one of the pair of reception links 28 in the widthwise direction of the base 1, as shown in FIG. 2. An upper coupling member 42, the two ends of which are coupled to the pair of reception links 28, is mounted to one end portion (upper end portion) of each of the pair of reception links 28. Therefore, each of the pair of right and left links 28 is interlockingly pivoted about the corresponding one end portion.

As shown in FIGS. 5 and 9, a storage portion **28*b* surrounded by the bottom surface portion 29, the pair of side surface portions 30 and 31, and the reception portion 32 formed on the upper end of the outer side surface portion 31 is formed in each reception link 28 throughout almost the overall length of the reception link 28 along the longitudinal direction. A slider 43 is housed in the storage portion 28*b* to be slidable along the longitudinal direction of the reception link 28**.

Figure 3:
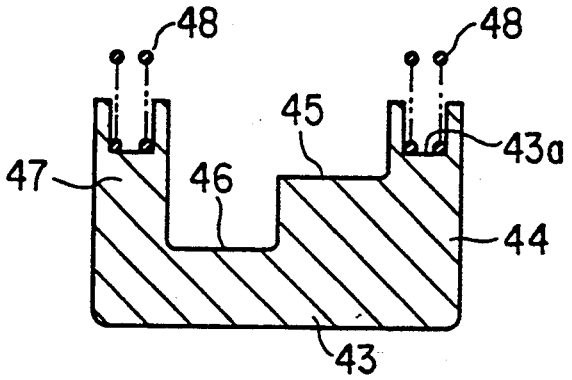
FIG. 3 is a sectional view of a slider of the first embodiment.

AS shown in FIGS. 3 and 5, the slider 43 is made of a polyacetal resin or the like. The slider 43 comprises a front end portion 44 formed so as to be directed toward the other end portion of the reception link 28, a front stepped portion 45 notched downward by one step from the upper end face of the front end portion 44, a rear stepped portion 46 connected to the front stepped portion 45 and notched downward by one step from the front stepped portion 45, and a rear end portion 47 formed so as to be directed toward one end portion of the reception link 28. A storage hole 43*a* for receiving the lower portion of a spring body 48 is formed in the upper end faces of the front and rear end portions 44 and 47.

When the slider 43 is stored in the storage portion 28*b* of the reception link 28, the slider 43 is elastically urged against the bottom surface portion 29 by the spring bodies 48. In this state, the upper surface of the front stepped portion 45 of the slider 43 has almost the same level as that of a lower side surface 39*c* of the elongated groove 39 in the reception link 28, as shown in FIG. 5. The upper surface of the rear stepped portion 46 of the slider 43 has almost the same level as that of a lower end face 40a of each engaging portion 40 of the reception link 28.

The lower end portion of the support link 20 which has the engaging pin 22 is inserted into the storage portion 28*b* from the opening 28*a* of the reception link 28, as shown in FIG. 9. One end 22*a* of the engaging pin 22 is located between the front and rear end portions 44 and 47 of the slider 43, and the other end 22*b* of the engaging pin 22 extends outward from the elongated groove 39.

The slider 43 is urged against the bottom surface portion 29 of the reception link 28 by the elastic force of the spring bodies 48. For this reason, the slider 43 will not slide by its own weight even if the reception link 28 is inclined. However, when a predetermined force acts on the slider 43 in a sliding direction, the slider 43 can be slid within the reception link 28.

More specifically, when the elastic force of the spring bodies 48 is excessively large, the slider 43 cannot be smoothly slid. However, when the elastic force is excessively small, the slider may slide downward by its own weight. Therefore, the elastic force of the spring bodies 48 is set such that the slider 43 can be smoothly slid but will not slide downward by its own weight.

When the reception link 28 is located at an angle indicated by a solid line in FIG. 4, one end 22*a* of the engaging pin 22 which is formed at the other end portion serving as the longitudinal lower end of the support link 20 is locked on the front stepped portion 45 of the slider 43, as shown in FIG. 9, and the other end 22*b* is locked at the distal end of the lower linear portion 39*b* of the elongated groove 39 of the reception link 28 and extends outward.

In the bed apparatus having the structure described above, as indicated by the solid line in FIG. 4, one end 22*a* of the engaging pin 22 which is formed at the lower end of the support link 20 is locked on the front stepped portion 45 of the slider 43, and the other end 22*b* is locked at the distal end of the lower linear portion 39*b* of the elongated groove 39. In this state, the reception link 28 is held at the angle indicated by the solid line in FIG. 4. That is, since the fixing member 11, the support link 20, and the reception link 28 constitute three sides of a triangle having the engaging pin 22 and the pins 26 and 38 as three vertices, the base 1 is held at the lowest position indicated by $H_1$ in FIG. 1 by the link mechanism 10.

When the base 1 is slightly lifted in the above state, the reception link 28 is pivoted about the pin 38 clockwise as indicated by an arrow Y in FIG. 4, by the weight of the reception link 28. Upon pivotal movement of the reception link 28, the other end 22*b* of the engaging pin 22 is moved upward in the elongated groove 39 of the reception link 28, as indicated by an arrow Z. At the same time, one end 22a of the engaging pin 22 abuts against the inner surface of the rear end portion 47 of the slider 43 to move the slider 43 upward, thereby sliding the slider 43 in the storage portion 28*b* of the reception link 28.

The slider 43 is urged against the bottom surface 29 of the reception link 28 by the elastic force of the spring body 48. However, since the reception link 28 is considerably heavy, the moment produced upon pivotal movement of the reception link 28 becomes larger than a frictional force produced by the elastic force of the spring body 48. That is, the elastic force of the spring body 48 is set such that the moment of rotation produced by the reception link 28 is larger than the sliding resistance of the slider 43. Therefore, the slider 43 slides upward together with the engaging pin 22 in the storage portion 28*b* to cause the support link 20 to pivot in a direction indicated by an arrow X in FIG. 4.

To support the base 1 at a predetermined height, when the reception link 28 is pivoted to some extent in a direction indicated by an arrow Y, the base 1 is moved downward to bring the lower coupling member 41 into contact with the ground. The reception link 28 is pivoted in a counterclockwise direction which is opposite to the pivot direction (Y direction) of its own weight, so that the other end 22*b* of the engaging pin 22 is engaged with the corresponding engaging portion 40 located therebelow while being slightly displaced downward.

The counterclockwise pivotal movement of the reception link 28 is prevented at this position, and the base 1 of the bed apparatus can be held at a predetermined height by the link mechanism 10. At this time, one end 22*a* of the engaging pin 22 is located on the rear stepped portion 46 of the slider 43, as indicated by the chain double-dashed line in FIG. 4.

As described above, when the engaging pin 22 is moved from the lowermost position where it is engaged with the distal end of the lower linear portion 39*b* of the elongated groove 39 to one of the engaging portions 40 at a predetermined position, thereby variously changing the support height.

In the state indicated by the chain double-dashed line in FIG. 4, the other end 22*b* of the engaging pin 22 is engaged with the uppermost engaging portion 40, so that the base 1 is supported at the highest position.

To change the support position of the base 1 from the uppermost position to a lower position, the base 1 is lifted in a state wherein the other end 22*b* of the engaging pin 22 is engaged with the uppermost engaging portion 40. The reception link 28 is further pivoted in the direction indicated by the arrow Y by its own weight.

During pivotal movement of the reception link 28, the engaging pin 22 is disengaged from the uppermost engaging portion 40 indicated by the chain double-dashed line in FIG. 4 and is moved to the upper linear portion 39*a* of the elongated groove 39, as shown in FIG. 5. At the same time, one end 22*a* of the engaging pin 22 abuts against the inner surface of the rear end portion 47 of the slider 43 to further move the slider 43 upward, so that the other end 22*b* is moved to a position until it is locked with the distal end of the upper linear portion 39*a*.

The front stepped portion 45 of the slider 43 is located to a position above the uppermost engaging portion 40 of the reception link 28. The upper surface of the front stepped portion 45 is located at the same level as that of the lower end face 39*a* of the elongated groove 39. In this state, when the base 1 is moved downward to bring the lower coupling portion 41 of the link mechanism 10 into contact with the ground, the reception link 28 is pivoted in the counterclockwise direction opposite to the direction indicated by the arrow Y. One end 22*a* of the engaging pin 22 which has been in contact with the inner surface of the rear end portion 47 of the slider 43 passes above the rear stepped portion 46 of the slider 43 and is moved to the front stepped portion 45. Said one end 22*a* finally abuts against the inner surface of the front end portion 44.

The other end 22*b* of the engaging pin 22 is slid along the upper linear portion 39*a*. At this time, since the front stepped portion 45 is located at a position almost corresponding to the uppermost engaging portion 40 of the reception link 28, the other end 22*b* of the engaging pin 22 is slid without being engaged with the uppermost engaging portion 40.

Upon further pivotal movement of the reception link 28, the engaging pin 22, one end 22*a* of which is in contact with the inner surface of the front end portion 44, slides urging the slider 43 by the front stepped portion 45 until the other end 22*b* is locked with the distal end of the lower linear portion 39*a* while the other end 22*b* is prevented from being engaged with any engaging portion 40. Since the reception link 28 lies at the position indicated by the solid line in FIG. 4, the base 1 is supported at the lowest position indicated by $H_1$ in FIG. 1, which position corresponds to a lying angle of the reception link 28.

In downward movement of the base 1, the slider 43 is urged against the reception link 28 by the spring body 48 and will not move downward by its own weight. The relative position between the slider 43 and the engaging pin 22 will not change. That is, the engaging pin 22 is kept in contact with the inner surface of the front end portion 44 of the slider 43.

While the engaging pin 22 is moved downward from the uppermost end of the elongated groove 39 and brought into contact with the front end portion 44 of the slider 43 and the engaging pin 22 becomes engaged with the distal end portion of the lower linear portion 39*b*, the slider 43 will not slide downward by its own weight, and one end 22*a* of the engaging pin 22 will not be disengaged from the front stepped portion 45. Therefore, one end 22*a* will not be located to a position opposite to the rear stepped portion 46. Therefore, the slider 43 properly prevents the engaging pin 22 from engaging with any engaging portion 40.

Assume that the slider 43 tends to move downward by its own weight. When the engaging pin 22 is moved downward from the uppermost end of the elongated groove 39, the slider 43 is also slid downward. For this reason, the engaging pin 22 is moved toward the rear end portion 47 from the state wherein the engaging pin 22 is kept locked on the inner surface of the front end portion 45 of the slider 43, and the engaging pin 22 is engaged with one of the engaging portions 40 of the reception link 28, thereby preventing pivotal movement in a direction to further incline the reception link 28. Therefore, the base 1 cannot be moved downward.

According to the present invention, however, since the slider 43 is held not to slide by its own weight due to the elastic force of the spring body 48, as described above, the support height of the base 1 can properly decrease.

The pivotal movements of the pair of reception links 28 corresponding in the widthwise direction of the base and coupled by the pair of coupling members 41 and 42 are interlocked in upward or downward movement of the base 1. For this reason, even if the base 1 is lifted inclining in the widthwise direction, the pivot angles of the pair of reception links 28 will not be differentiated. Therefore, the support height of the base 1 can change without any inclination in the widthwise direction of the base 1.

Figure 10:
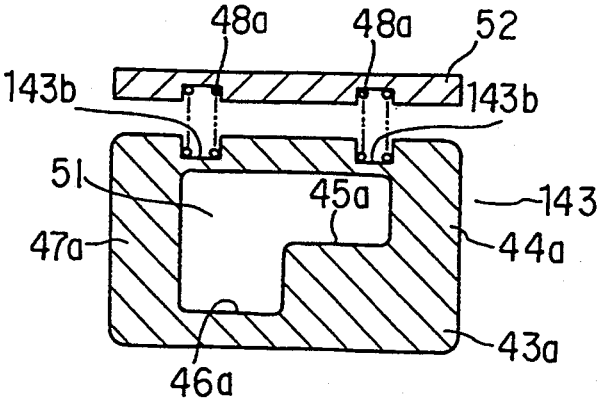
FIG. 10 is a sectional view of a slider according to the second embodiment of the present invention.

FIG. 10 shows the second embodiment of the present invention. This embodiment will exemplify a modification of the slider. A slider 143 has a rectangular block-like main body 143*a* made of a synthetic resin such as Delrin. A through hole 51 is formed in the main body 143*a*. A front end portion 44*a* is formed at one end portion of the main body 143*a* in the back-and-forth direction. A rear end portion 47*a* is formed in the other end portion of the main body 143*a*. A front stepped portion 45*a* and a rear stepped portion 46*a* connected to the front stepped portion 45*a* and notched downward by one step from the front stepped portion 45*a* are formed stepwise between the front and rear end portions 44*a* and 47*a*.

A pair of storage holes 143*b* are formed in the upper surface of the main body 143*a* in the back-and-forth direction. One end portion of each of spring bodies 48*a* is received in and held in a corresponding one of the storage holes 143*b*. The other end portion of each of these spring bodies 48*a* is held on an upper plate 52 made of the same material as that of the main body 143*a*.

When the slider 143 having the above structure is housed in the storage portion 28*b* of the reception link 28 shown in the first embodiment, the lower surface of the main body 143*a* and the upper surface of the upper plate 52 are urged against the inner surface of the storage portion 28*b* by the elastic forces of the spring bodies 48*a*. In the storage portion 28*b*, the slider 143 can be set in a state wherein the slider 143 will not freely slide by its own weight.

According to the present invention, as has been described above, the support height of a base of a bed apparatus can be changed in several steps, and the bed apparatus can be properly set by a user at a desired height. In addition, link mechanisms for changing the support height are simple mechanisms without using a drive source, thereby providing such a link mechanism at low cost. In addition, the base is slightly lifted to change the support height, thereby advantageously providing a convenient bed apparatus with excellent operability.

I claim:

1. A bed apparatus capable of changing a support height of a base having an upper surface on which a mattress is placed, comprising:

a support link having two end portions, one end portion of said support link being pivotally coupled to said base, an elongated reception link having a storage portion surrounded by side walls, said storage portion and said side walls extending along a longitudinal direction of said reception link, said storage portion pivotally receiving therein the other end portion of said support link, and said reception link having two end portions, one end portion of said reception link being pivotally coupled to said base at a position spaced apart from said one end portion of said support link by a predetermined distance, an elongated guide portion on at least one side wall of said reception link, said guide portion including a plurality of engaging portions arranged from one longitudinal end portion to another longitudinal end portion of said guide portion, an engaging pin at the other end portion of said support link and which is slidably inserted in said guide portion, and a slider which is slidable relative to said reception link when a larger force than a weight of said slider acts on said storage portion of said reception link, said slider being slid upon engagement with said engaging pin, said slider inhibiting engagement of said engaging pin with said engaging portions when said engaging pin is slid from said one end portion to said another end portion of said guide portion, and said slider allowing engagement of said engaging pin with an engaging portion when said engaging pin is slid from said another end portion to said one end portion of said guide portion.

2. A bed apparatus according to claim 1, wherein said slider comprises:

a front stepped portion for preventing said engaging pin from being engaged with said engaging portions; and a rear stepped portion for allowing said engaging pin to be engaged with an engaging portion;

said front and rear stepped portions being formed stepwise, such that said front stepped portion is directed toward the other end portion of said reception link; and said slider is received in said storage portion of said reception link.

3. A bed apparatus according to claim 1, further comprising at least one spring disposed between an end face of said slider and an inner surface of said storage portion, and wherein said slider has a sliding resistance in said storage portion which is set in accordance with an elastic force of said at least one spring.

4. A bed apparatus according to claim 3, wherein the sliding resistance of said slider which is set by said elastic force of said at least one spring is set to be smaller than a moment of rotation produced during a pivotal movement of said reception link by a weight of said reception link.

5. A bed apparatus according to claim 1, wherein:

said support link comprises a set of two support links each having one end portion pivotally coupled to corresponding respective positions spaced apart in a widthwise direction of said base; and said base comprises two sets of support links arranged at predetermined intervals in a longitudinal direction of said base;

said two support links of each of said two sets being coupled by a respective coupling member so as to pivot together with respect to said base.

6. A bed apparatus according to claim 1, wherein:

said guide portion comprises an elongated groove formed in one side wall of said reception link; and said engaging portions comprise a plurality of recesses formed in said one side wall and arranged to communicate with said elongated groove.

7. A bed apparatus according to claim 1, wherein said slider is slidably received in said storage portion of said reception link.

* * * * *